US011002421B2

(12) United States Patent
Brueggemann et al.

(10) Patent No.: US 11,002,421 B2
(45) Date of Patent: May 11, 2021

(54) SPOTLIGHT/HEADLIGHT, IN PARTICULAR HEADLIGHT OF A MOTOR VEHICLE

(71) Applicant: HELLA GmbH & CO. KGAA, Lippstadt (DE)

(72) Inventors: Daniel Brueggemann, Lippstadt (DE); Susanne Hagedorn, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/780,393

(22) Filed: Feb. 3, 2020

(65) Prior Publication Data

US 2020/0173621 A1 Jun. 4, 2020

Related U.S. Application Data

(63) Continuation of application No. PCT/EP2018/070564, filed on Jul. 30, 2018.

(30) Foreign Application Priority Data

Aug. 1, 2017 (DE) ..... 10 2017 117 376.5

(51) Int. Cl.
*F21S 41/255* (2018.01)
*F21S 41/14* (2018.01)
(Continued)

(52) U.S. Cl.
CPC ..... *F21S 41/255* (2018.01); *F21S 41/14* (2018.01); *F21S 41/143* (2018.01); *F21S 41/151* (2018.01);
(Continued)

(58) Field of Classification Search
CPC ..... F21S 41/143; F21S 41/151; F21S 41/14; F21S 41/24; F21S 41/26; F21S 41/255;
(Continued)

(56) References Cited

U.S. PATENT DOCUMENTS 7,934,861 B2 5/2011 Albou
8,104,939 B2 1/2012 Coushaine et al.
(Continued)

FOREIGN PATENT DOCUMENTS

DE 102015104514 A1 9/2016
EP 1936260 A1 6/2008
(Continued)

OTHER PUBLICATIONS

International Search Report dated Oct. 24, 2018 in corresponding application PCT/EP2018/070564.

*Primary Examiner* — Zheng Song
(74) *Attorney, Agent, or Firm* — Muncy, Geissler, Olds & Lowe, P.C.

(57) ABSTRACT

A headlamp having a plurality of light sources which emit light during the operation of the headlamp, a primary optical unit, which at least partially shapes the light emanating from the light sources, a secondary optical unit, which includes a first optically functional boundary surface having at least one first section and at least one second section. A first portion of the light emanating from the primary optical unit passing through the at least one first section, and a second portion passing through the at least one second section. The at least one first section having a positive refractive power at least with respect to a first direction and the second section having a lower refractive power than the first section or as a lens having a negative refractive power at least with respect to the first direction.

9 Claims, 2 Drawing Sheets

(51) Int. Cl.

| | |
|---|---|
| *F21S 41/24* | (2018.01) |
| *F21W 102/13* | (2018.01) |
| *F21S 41/151* | (2018.01) |
| *F21S 41/143* | (2018.01) |
| *F21S 41/26* | (2018.01) |

(52) U.S. Cl.
CPC ..... *F21S 41/24* (2018.01); *F21S 41/26* (2018.01); *F21W 2102/13* (2018.01)

(58) Field of Classification Search
CPC ..... F21S 41/265; F21S 43/00; F21V 5/04; F21W 2102/13
See application file for complete search history.

(56) References Cited

U.S. PATENT DOCUMENTS

| | | | | |
|---|---|---|---|---|
| 10,054,279 | B2 | 8/2018 | Kliebisch | |
| 2008/0151567 | A1* | 6/2008 | Albou | F21S 41/663 326/507 |
| 2015/0023040 | A1* | 1/2015 | Tatsukawa | F21S 41/148 362/517 |
| 2015/0167913 | A1 | 6/2015 | Stefanov et al. | |
| 2015/0252975 | A1* | 9/2015 | Nakada | F21S 41/265 362/521 |
| 2016/0230948 | A1 | 8/2016 | Kratochvil et al. | |
| 2016/0238208 | A1* | 8/2016 | Wang | F21S 41/255 |
| 2017/0030543 | A1 | 2/2017 | Gromfeld et al. | |
| 2017/0089537 | A1* | 3/2017 | Tsuchiya | F21S 41/285 |
| 2017/0241605 | A1* | 8/2017 | Yamamoto | F21S 41/148 |
| 2018/0149336 | A1* | 5/2018 | Tsai | F21S 41/143 |
| 2018/0187851 | A1* | 7/2018 | Hossfeld | F21S 43/40 |
| 2018/0216794 | A1* | 8/2018 | Marchal | F21S 41/40 |

FOREIGN PATENT DOCUMENTS

| | | | |
|---|---|---|---|
| EP | 2607778 | A1 | 6/2013 |
| JP | 2010073426 | A | 4/2010 |
| JP | 2010218964 | A | 9/2010 |
| JP | 2012109062 | A | 6/2012 |
| JP | 2013149443 | A | 8/2013 |
| JP | 2017191722 | A | 10/2017 |

* cited by examiner

SPOTLIGHT/HEADLIGHT, IN PARTICULAR HEADLIGHT OF A MOTOR VEHICLE

This nonprovisional application is a continuation of International Application No. PCT/EP2018/070564, which was filed on Jul. 30, 2018, and which claims priority to German Patent Application No. 10 2017 117 376.5, which was filed in Germany on Aug. 1, 2017, and which are both herein incorporated by reference.

BACKGROUND OF THE INVENTION

Field of the Invention

The present invention relates to a headlamp, in particular a headlamp of a motor vehicle.

Description of the Background Art

A headlamp is known from DE 10 2015 104 514 A1, which corresponds to U.S. Pat. No. 10,054,279, which is incorporated herein by reference. The headlamp described therein comprises two light modules, one of which has a plurality of light-emitting diodes (LEDs). A rod-like or finger-like light conductor used as a primary optical unit is assigned to each of the light-emitting diodes and extends from the light-emitting diode to a diffuser, in front of which the light emerges from the light conductor. A secondary optical unit is disposed behind the diffuser, which is made up of a plurality of optically functional boundary surfaces acting as lenses and which projects the light distribution present behind the diffuser into the traffic area.

SUMMARY OF THE INVENTION

It is therefore an object of the present invention to provide a headlamp of the type mentioned at the outset, in which the shaping of the light distribution generated by the headlamp is achieved by simple means.

In an exemplary embodiment, at least one first section is designed as a lens having a positive refractive power, at least with respect to a first direction, which corresponds to the horizontal direction in the state of the headlamp installed in a motor vehicle, and the second section has a planar design or is designed as a lens having a lower refractive power than the first section or as a lens having a negative refractive power at least with respect to the first direction. This makes it possible to optimize the light emanating from the primary optical unit for different purposes. For example, a portion of the light provided for a high beam or a low beam may pass through the at least one first section. The positive refractive power of the first section may collimate or focus this portion of the light, so that it may be used as a range portion. Another portion of the light may furthermore pass through the at least one second section, which may be, for example, planar. The portion of the light which has passed through the second section is not collimated or focused thereby. For example, this portion may contribute to a wide illumination of the field of vision situated in front of the motor vehicle.

For example, the at least one first section may be designed as a cylindrical lens having a positive refractive power with respect to the first direction. Alternatively, the at least one first section may be designed as a lens, which has a positive refractive power in the first direction as well as in a second direction perpendicular thereto, which corresponds to the vertical direction in the state of the headlamp installed in the vehicle. Due to the refractive power in the second direction, the first section may perform additional functions of collimation or focusing with respect to the vertical direction.

It may be provided that the at least one first section and the at least one second section are arranged next to each other. In particular, the sections may be situated next to each other in the state installed in the motor vehicle, so that, as a whole, a relatively low installation height of the headlamp or a relatively low height of the light outlet surface of the headlamp may result. In particular, the height of the light outlet surface of the headlamp may be less than 50 mm, for example approximately 25 mm, in size.

It is possible that the secondary optical unit has a second optically functional boundary surface, which is at least partially designed as a cylindrical lens. The light emanating from the primary optical unit may be shaped by this cylindrical lens on the second boundary surface, in particular, with respect to a different direction than by the at least one section of the first boundary surface acting, in particular, as a cylindrical lens.

For example, the cylinder axis of the at least one first section of the first optically functional boundary surface designed, in particular, as a cylindrical lens may be oriented perpendicularly to the cylinder axis of the cylindrical lens of the second optically functional boundary surface.

It may be provided that the cylinder axis of the at least one first section of the first optically functional boundary surface designed, in particular, as a cylindrical lens is oriented vertically in the state installed in the motor vehicle, and/or the cylindrical lens of the second optically functional boundary surface is oriented horizontally in the state installed in the motor vehicle. The at least one first section acting, in particular, as a cylindrical lens may thus effectuate a collimation or focusing in the horizontal direction, while the cylindrical lens on the second boundary surface may effectuate a collimation or focusing in the vertical direction.

It is possible that the first optically functional boundary surface is an inlet surface, through which the light enters the secondary optical unit or a part of the secondary optical unit. It may furthermore be provided that the second optically functional boundary surface is an outlet surface, through which the light emerges from the secondary optical unit or a part of the secondary optical unit, the second optically functional boundary surface being situated, in particular, opposite the first optically functional boundary surface. The two boundary surfaces may be formed, in particular, on a component, the first boundary surface being the inlet surface of this component and the second boundary surface being the outlet surface thereof.

It is possible that the light sources are designed as light-emitting diodes or a semiconductor lasers. Designing the light sources as semiconductor-based components results in a high effectiveness and a compact structure of the headlamp.

It may be provided that the primary optical unit includes a plurality of light conductors, each of the light sources being assigned, in particular, to one of the light conductors in such a way that the light of the light source enters the light conductor and is shaped thereby. In particular, at least one first of the light conductors may have different light shaping properties than at least one second of the light conductors. As a result, the light of different light sources may be shaped differently, so that the light distribution output by the primary optical unit may be modeled in a targeted manner.

It is possible to provide the primary optical unit and/or the secondary optical unit with a modular design, so that the width of the optical units may be increased as needed. For example, multiple first and/or second sections of the first optically functional boundary surface of the secondary optical unit, in particular a large number of first and/or second sections, may be arranged next to each other in a modular manner. In the case of the modular design, a large number of light conductors of the primary optical unit, and a large number of light sources assigned to the light conductors, may consequently also be arranged next to each other in a modular manner.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
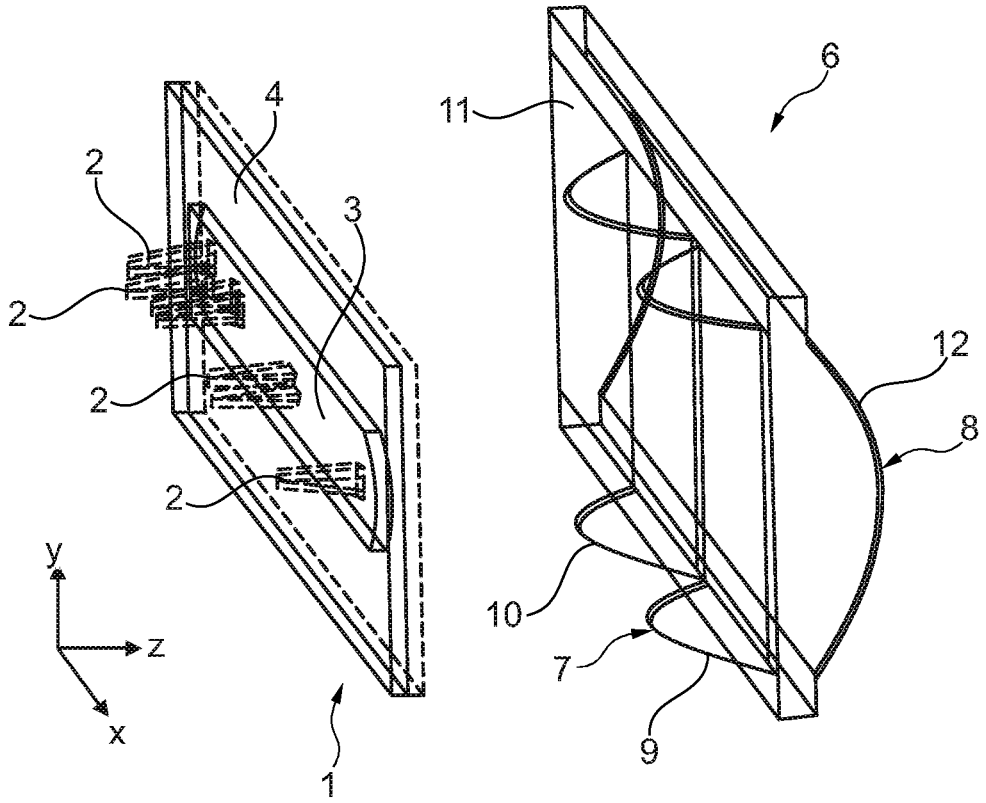
FIG. 1 shows a schematic exploded view of one part of a headlamp according to the invention.
Figure 2:
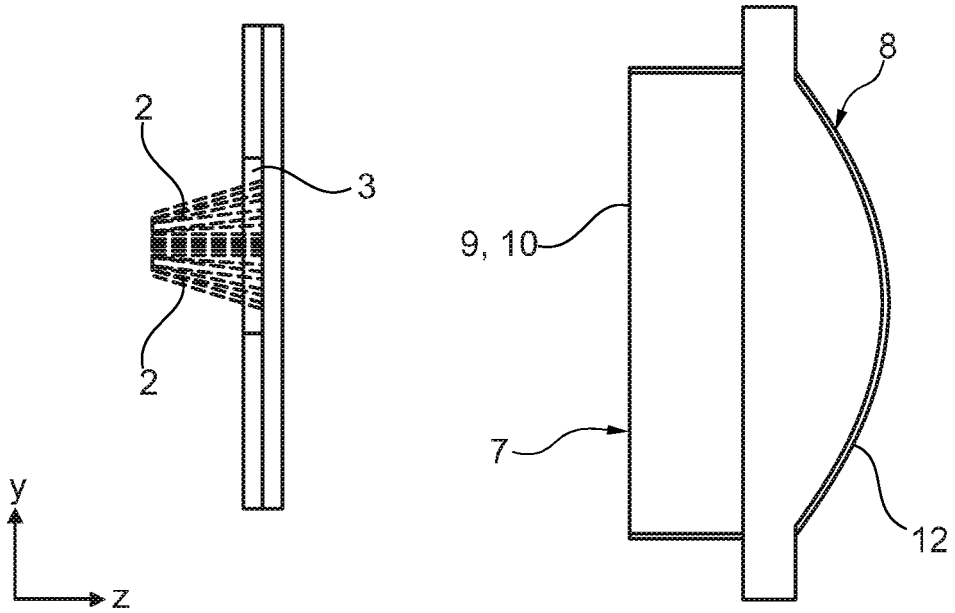
FIG. 2 shows a side view of the part of the headlamp according to FIG. 1.
Figure 3:
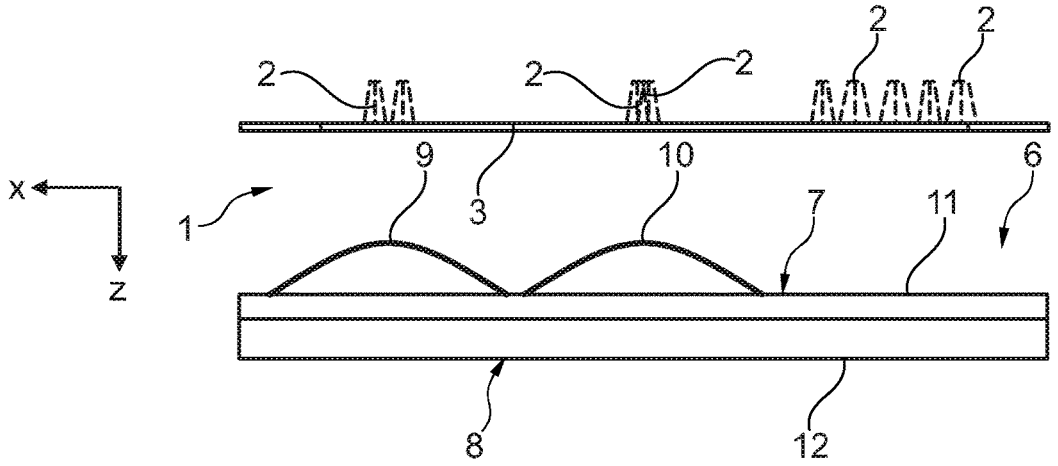
FIG. 3 shows a top view of the part of the headlamp according to FIG. 1.

Cartesian coordinate systems are drawn in the figures for better orientation. In the state installed in the motor vehicle, the X direction designates the vehicle transverse direction, the Y direction designates the vertical direction, and the Z direction designates the vehicle longitudinal direction.

The headlamp according to the invention, which is partially shown in FIG. 1 through FIG. 4, comprises a plurality of light sources, which may be designed, in particular, as light-emitting diodes (LEDs). The headlamp further comprises a primary optical unit 1, which includes a plurality of light conductors 2, which extend essentially in the Z direction. One of the light-emitting diodes is disposed on the left end of each of light conductors 2 in FIG. 1 or the upper end thereof in FIG. 3, so that the light of the light-emitting diode is able to enter light conductor 2 assigned thereto. Light conductors 2 may be made from silicone, for example, and possibly also from polymethyl acrylate (PMMA) or polycarbonate. If light conductors 2 are made from silicone, they may all end in a mat made from silicone, which connects light conductors 2.

In the illustrated exemplary embodiment, primary optical unit 1 furthermore includes a plate 3 made from a transparent material, for example glass or polycarbonate. Light conductors 2 end at this plate 3, or the mat abuts light conductors 2, which may be made from silicone. In particular, light conductors 2 are held in position by this plate 3. The light emerging from light conductors 2 may pass through plate 3 in the Z direction to the right in FIG. 1 or downwardly in FIG. 3. Plate 3 may be surrounded by a frame 4. For example, frame 4 may be made from polycarbonate or Alusi, a steel having an aluminum/silicon coating.

Figure 4:
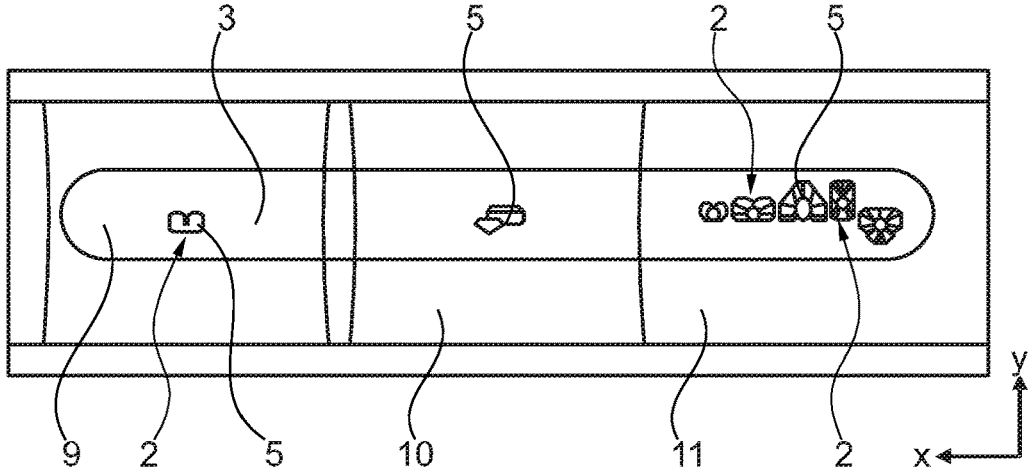
FIG. 4 shows a front view of the part of the headlamp according to FIG. 1.

In the illustrated exemplary embodiment, light conductors 2 are provided with individual shapes, so that, in particular, the light emanating from the light-emitting diodes assigned to light conductors 2 is shaped differently by each of light conductors 2. FIG. 4 show differently shaped outlet surfaces 5 of light conductors 2, which induce a different light distribution of the light emerging from light conductors 2.

The headlamp also comprises a secondary optical unit 6 made up of a one-piece, transparent component, through which the light emerging from primary optical unit 1 passes essentially in the Z direction. Secondary optical unit 6 includes a first optically functional boundary surface 7 acting as an inlet surface and a second optically functional boundary surface 8 acting as an outlet surface, which are situated opposite each other in the Z direction. Secondary optical unit 6 may be made from glass or plastic.

In the illustrated exemplary embodiment, first optically functional boundary surface 7 includes two first cylindrical sections 9, 10 arranged next to each other, which are provided with a convex shape and therefore have a positive refractive power. First optically functional boundary surface 7 also includes a second planar section 11, which is disposed next to one of first sections 9, 10 (cf. FIG. 1 and FIG. 3). The cylinder axes of cylindrical sections 9, 10 extend in the Y direction or, for example, vertically, in the state installed in the motor vehicle.

It is entirely possible that first sections 9, 10 are not exclusively cylindrical but are designed as a freeform surface and, in addition to the curvature acting upon the X direction as illustrated in FIG. 1, also have a preferably slight curvature, which acts upon the Y direction. As a result, first sections 9, 10 may also perform a collimating or focusing function with respect to the vertical direction. It should be noted that the additional curvature of first sections 9, 10 acting upon the Y direction is not illustrated in the figures showing an exemplary embodiment.

It is also entirely possible to provide more or fewer first sections. More than one second section may also be provided. It is also possible that the at least one second section is not planar but has a curvature, which is smaller than the curvature of the at least one first section, or which has a concave curvature, so that it has a negative refractive power.

In the illustrated exemplary embodiment, second optically functional boundary surface 8 is designed as a cylindrical lens 12, which is provided with a convex shape and therefore has a positive refractive power. The cylinder axis of cylindrical lens 12 extends perpendicularly to the cylinder axes of first sections 9, 10. The cylinder axis of cylindrical lens 12 thus extends in the X direction or horizontally in the state installed in the motor vehicle.

It is possible that secondary optical unit 6 as a whole is slightly curved to adapt it to a curved vehicle contour. The curvature may take place, for example, in the horizontal direction to permit an adaptation to a headlamp cover extending somewhat to the side from the front of the vehicle.

A housing is provided, in which primary optical unit 1 and secondary optical unit 6 are both held.

Figure 5:
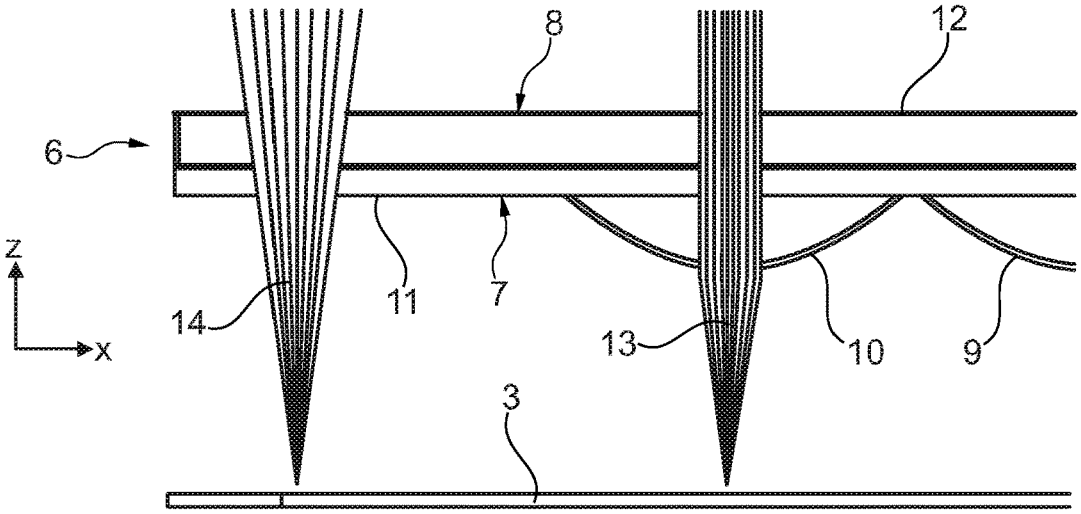
FIG. 5 shows a schematic top view of the part of the headlamp according to FIG. 1, in which the optical paths of the light through the different areas of the first optically functional boundary surface are illustrated.

FIG. 5 clarifies how first optically functional boundary surface 7 contributes to the shaping of the light emerging from the headlamp. Two examples of light beams 13, 14 are drawn, which emerge from plate 3 of primary optical unit 1. The two light beams 13, 14 have a divergence in the X direction, or in the horizontal direction.

Light beam 13, which enters secondary optical unit 6 through first cylindrical section 10, undergoes a divergence-reducing refraction on boundary surface 7. Light beam 13 is largely collimated. Light beam 14, which enters secondary optical unit 6 through second planar section 11, does not undergo the divergence-reducing refraction on boundary surface 7. Light beam 14 is therefore divergent even after it emerges from second boundary surface 8 in the X direction, or in the horizontal direction.

The divergence of the two light beams 13, 14 is reduced by cylindrical lens 12 in the Y direction, or in the vertical direction.

Due to the shape of first optically functional boundary surface 7, it is possible to allow portions of the light emerging from primary optical unit 1 to pass through cylindrical first sections 9, 10 so that they are collimated or focused in the horizontal direction. As a result, these portions may contributed to range portions of the light distribution, which may be part, for example, of a high beam or a low beam.

It is furthermore possible to allow other portions of the light emerging from primary optical unit 1 to pass through planar secondary section 11, so that they may divergently spread out in the horizontal direction. These portions may, for example, contribute to a wide illumination of the field of vision situated in front of the motor vehicle.

It may be provided to assign different numbers of light sources or light conductors 2 of primary optical unit 1 to individual sections 9, 10, 11 of first optically functional boundary surface 7 (cf., for example, FIG. 4).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A headlamp of a motor vehicle, the headlamp comprising:

at least two light sources that emit light during an operation of the headlamp;

a primary optical unit, which at least partially shapes the light emanating from the light sources;

a secondary optical unit, which includes a first optically functional boundary surface through which the light emanating from the primary optical unit passes, the first optically functional boundary surface having at least one first section and at least one second section, which are arranged such that a first portion of the light emanating from the primary optical unit passes through the at least one first section, and a second portion of the light emanating from the primary optical unit passes through the at last one second section, wherein the at least one first section is a cylindrical lens having a positive refractive power at least with respect to a first direction, which corresponds to a horizontal direction in a state of the headlamp installed in the motor vehicle, wherein the second section is a planar lens having a lower refractive power than the at least one first section, and wherein the secondary optical unit has a second optically functional boundary surface that opposes the first optically functional boundary surface, the second optically functional boundary surface having a straight cylindrical lens extending along an entire length of the secondary optical unit.

2. The headlamp according to claim 1, wherein the primary optical unit includes a plurality of light conductors, and wherein each of the at least two light sources are assigned to a respective one of the light conductors such that the light of the light source enters the light conductor and is shaped thereby.

3. The headlamp according to claim 2, wherein at least a first one of the light conductors has different light shaping properties than at least a second one of the light conductors.

4. The headlamp according to claim 1, wherein the first direction corresponds to a vertical direction in the state of the headlamp installed in the motor vehicle.

5. The headlamp according to claim 1, wherein the at least one first section and the at least one second section are arranged next to each other.

6. The headlamp according to claim 1, wherein a cylinder axis of the at least one first section of the first optically functional boundary surface is oriented substantially perpendicularly to a cylinder axis of the cylindrical lens of the second optically functional boundary surface.

7. The headlamp according to claim 1, wherein a cylinder axis of the at least one first section of the first optically functional boundary surface is oriented vertically in the state installed in the motor vehicle and a cylinder axis of the cylindrical lens of the second optically functional boundary surface is oriented horizontally in the state installed in the motor vehicle.

8. The headlamp according to claim 1, wherein the first optically functional boundary surface is an inlet surface, through which the light enters the secondary optical unit or a part of the secondary optical unit, and/or the second optically functional boundary surface is an outlet surface, through which the light emerges from the secondary optical unit or a part of the secondary optical unit.

9. The headlamp according to claim 1, wherein the at least two light sources are light-emitting diodes or semiconductor lasers.

* * * * *